US007834289B2

(12) United States Patent
Orbke et al.

(10) Patent No.: US 7,834,289 B2
(45) Date of Patent: Nov. 16, 2010

(54) MAIL PROCESSING SYSTEM FOR ADDRESS CHANGE SERVICE

(75) Inventors: Wayne Henry Orbke, Germantown, TN (US); John Sadler, Dunkirk, MD (US); William Andrew Grady, Bedford, TX (US); Richard Wojdyla, Wadsworth, IL (US); Walter S. Conard, Lake Villa, IL (US)

(73) Assignee: Bowe Bell & Howell Company, Durham, NC (US)

( * ) Notice: Subject to any disclaimer, the term of this patent is extended or adjusted under 35 U.S.C. 154(b) by 534 days.

(21) Appl. No.: 11/848,136

(22) Filed: Aug. 30, 2007

(65) Prior Publication Data

US 2009/0057207 A1 Mar. 5, 2009

(51) Int. Cl.
*B07C 3/00* (2006.01)

(52) U.S. Cl. ..... 209/584; 209/3.3; 209/900; 382/101; 700/224; 700/226; 700/227

(58) Field of Classification Search ..... 209/3.3, 209/583, 584, 900; 700/224; 382/101, 102
See application file for complete search history.

(56) References Cited

U.S. PATENT DOCUMENTS 4,632,252 A * 12/1986 Haruki et al. ..... 209/546
5,422,821 A 6/1995 Allen et al.
5,612,889 A * 3/1997 Pintsov et al. ..... 700/226
5,703,783 A 12/1997 Allen et al.
5,925,864 A * 7/1999 Sansone et al. ..... 235/375
6,385,504 B1 * 5/2002 Pintsov et al. ..... 700/226
6,532,452 B1 * 3/2003 Pintsov et al. ..... 705/401
6,549,892 B1 * 4/2003 Sansone ..... 705/401
6,829,369 B2 * 12/2004 Poulin et al. ..... 382/101
7,304,261 B2 * 12/2007 Avant et al. ..... 209/584
2005/0149765 A1 * 7/2005 Aldstadt et al. ..... 713/300
2009/0143898 A1 * 6/2009 Kiani et al. ..... 700/226

* cited by examiner

*Primary Examiner*—Joseph C Rodriguez
(74) *Attorney, Agent, or Firm*—McDermott Will & Emery LLP

(57) ABSTRACT

Systems and methods are disclosed for processing a mailing including one or more mail pieces. The exemplary systems and method include capturing address data, addressee data, or address and addressee data associated with each respective mail piece of the mailing. A delivery point address code and a unique identifier are determined for the respective mail piece based at least in part on the captured address data, addressee data, or address and addressee data. In addition, a machine readable code is generated comprising at least a mailer identifier for the mailing and the unique identifier. The machine readable code is then printed on the respective mail piece. Also disclosed are exemplary systems and methods for retrieving a delivery point address code from a move data file. A machine readable code is generated from the delivery point address code and a unique identifier, and is printed on the mail piece.

22 Claims, 6 Drawing Sheets

54

| Type | Field | Digits | |
|---|---|---|---|
| Tracking Code | Barcode Identifer | 2 | 44 |
| | Service Type Identifer | 3 | 46 |
| | Mailer ID | 6 | 48 |
| | Unique Identifier (unique number and / or ACS match back code) | 9 | 50 |
| Routing Code | Delivery Point Address Code | 0, 5, 9, or 11 | 52 |

| | | | | | | | | | |
|---|---|---|---|---|---|---|---|---|---|
| | | | | **Matchback Code** | | | | | |
| first two letters in first name | | | first two letters in last name | | | last three numbers of street addr | | | |
| digit 1 | digit 2 | digit 3 | digit 4 | digit 5 | digit 6 | digit 7 | digit 8 | digit 9 | |

61 62 63 50

Fig. 4

| |
|---|
| **ACS -Address Change Service Data Record** |
| Mailer ID |
| Unique Identifier (unique number or Match back code) |
| Name |
| Old Address |
| New Address |
| move type -family / individual |
| move effective date mm/yy |

64 65 66

Fig. 5

MAIL PROCESSING SYSTEM FOR ADDRESS CHANGE SERVICE

TECHNICAL FIELD

The present subject matter relates to techniques and equipment that will enable the placement of a postal authority approved barcode on a mail piece. The barcode is printed on the mail piece by mail processing equipment and the barcode contains sufficient data to enable an address correction service and client address database update.

BACKGROUND

Maintaining the accuracy of address data is a significant problem for postal authorities, since every mailer who prints an undeliverable as addressed address on a mail piece, costs the postal authority significant expense in order to process that item. Several delivery attempts may be made and address correction techniques may be employed once the delivery fails and efforts are made by the postal authority to facilitate the correction of the address. A significant majority of the undeliverable mail comes from moves made by one or more members of a household. The United States Postal Service (USPS) has implemented an Address Correction Service (ACS) for many years. For a fee, the USPS will inform the mailer of all bad addresses that it encounters and then supply the correct address to the mailer so that the mailer's address list can be updated. The process of providing the ACS service has been both labor intensive and expensive. In addition, the alpha codes on the mail piece that authorize the service are difficult to read with optical character reader (OCR) technology. No-reads or read errors can occur during the OCR process, both of which render the ACS ineffective for that mail piece.

The USPS has implemented a new Intelligent Mailpiece Barcode (IMB), which also is referred to as the 4-State Customer Barcode (4CB), which contains significantly more data about the mail piece, the mailer, services selected (such as ACS), and delivery point address code than the current POSTNET barcode in common use today. USPS has introduced a method of providing electronic Address Change Service (ACS), referred to as OneCode ACS™ to mailers who adopt the Intelligent Mailpiece Barcode (IMB) on their mail pieces. ACS is an approved method for mailers to comply with the move update requirement of the USPS. Given the efficiencies gained by USPS with mailer adoption of IMB they are offering extremely attractive pricing on OneCode ACS notices versus traditional ACS notices. First Class OneCode ACS—for each Change of Address (COA) the first two notices are free with subsequent notices 0.05 cents each; Standard Mail—the first two notices are 0.02 cents each with subsequent notices 0.15 cents each. Traditional ACS pricing in comparison—First Class will be 0.06 cents each and Standard mail will be 0.25 cents each. Given this pricing, it can be expected that OneCode ACS will become the method of choice for those utilizing the ACS service in the future.

The conventional way to apply the IMB is through a data center processor and supporting software such as Bowe Bell+ Howell's Mail Manger 2010™. This technology adds the IMB to the address block of the documents to be printed. Since the address block will be visible through the window in the envelope after the document is inserted into the envelope, the IMB will be visible to the imaging system on USPS mail processing automation equipment. The data contained in the IMB will be used by USPS to provide the OneCode ACS service. The mailer will receive an electronic file to use to correct their address list for all defective addresses identified and updated by USPS.

However, for various reasons, it is not always desirable to use the data center processor to apply the IMB. The reasons for not utilizing this approach may include the cost to modify data center processor software to apply the IMB with the correct data encoded in the IMB into the print file, the cost of Mail Manager 2010 service, and the desire to print addresses on the envelope versus using windowed envelopes.

SUMMARY

The teachings herein alleviate one or more of the above noted problems by using mail processing equipment such as a mail sorter or imaging system attached to an inserter to read the address from the envelope with an OCR and use USPS approved Coding Accuracy Support Standards (CASS®) and Delivery Point Verification (DPV®) software to obtain a valid delivery point address code for the address.

In one example, a sorter, such as a Multi Line Optical Character Reader (MLOCR) sorter or other suitable device may print the IMB on the mail piece with the delivery point address code, mailer identification, or ACS service request, or any combination thereof, or other desirable data encoded into the IMB. One disadvantage of traditional ACS service is the difficulty associated with updating the mailer's address list. An exemplary embodiment improves upon this as the sorter may encode data into the IMB that will assist in the access to and updating of the effected addresses in the mailer's address list based on the data returned from USPS.

The detailed description provides an exemplary method for processing a mailing including one or more mail pieces. The method includes capturing address data, addressee data, or address and addressee data associated with each respective mail piece of the mailing. The method also includes determining a delivery point address code and a unique identifier for the respective mail piece based at least in part on the captured address data, addressee data, or address and addressee data. In addition, the method includes generating a machine readable code comprising at least a mailer identifier for the mailing and the unique identifier, and printing the machine readable code on the respective mail piece.

The detailed description also provides an exemplary system for processing a mailing including one or more mail pieces. The system includes an image capture device configured to capture address data, addressee data, or address and addressee data associated with each respective mail piece of the mailing. The output of an image capture device is at least the addressee and/or the address using optical character recognition techniques and address matching techniques from an address database to determine the delivery point address for the mail piece being processed. The system also has a processor configured to determine a delivery point address code and the unique identifier for the respective mail piece based at least in part on the captured address data, addressee data, or address and addressee data. The processor is also configured to generate a machine readable code comprising at least a mailer identifier for the mailing and the unique identifier. The system also includes a printer communicatively coupled to the processor, wherein the printer is configured to print the machine readable code on the respective mail piece.

In the exemplary systems and methods, the unique identifier may be determined by generating a match back code from the for accessing an address record in an address list, wherein the matchback code is based at least in part on the captured address data, addressee data, or address and addressee data.

The accuracy of the address record in the address list may be verified by using a lookup file having address, or addressee and address data. In another example, the unique identifier is determined by retrieving a predetermined match back code from a lookup file based at least in part on the captured address data, addressee data, or address and addressee data. In yet another example, the unique identifier is determined by a unique number defining the uniqueness of a respective mail piece for a predetermined period of time. In a further example, the delivery point address code is determined by retrieving address data, or address and addressee data from at least one data record in a move data file based on the captured address data, addressee data, or address and addressee data. In another example, the delivery point address code is determined by retrieving the delivery point address code from a national data directory based on the captured address data, addressee data, or address and addressee data.

The detailed description also provides an exemplary method for processing a mailing including one or more mail pieces, the method comprising capturing address data, addressee data, or address and addressee data associated with each respective mail piece of the mailing. The method also includes accessing a move data file having at least address data, addressee data, or address data and addressee data for move updates, using the captured address data. The method also includes retrieving a delivery point address code from the move data file, and generating a machine readable code using the delivery point address code and a unique identifier. The method also includes printing the machine readable code on the respective mail piece.

Another exemplary system provided in the detailed description relates to a system for processing a mailing including one or more mail pieces, the system comprising an image capture device configured to capture address data, addressee data, or address and addressee data associated with each respective mail piece of the mailing. The system also includes a processor configured to access a move data file from at least one digital storage device using the captured address data, the move data file having at least address data, addressee data, or address data and addressee data for move updates. The processor is further configured to retrieve a delivery point address code from the move data file, and generate a machine readable code using the delivery point address code and a unique identifier. The system also includes a printer configured to print the machine readable code on the respective mail piece.

Additional objects, advantages and novel features will be set forth in part in the description which follows, and in part will become apparent to those skilled in the art upon examination of the following and the accompanying drawings or may be learned by production or operation of the examples. The objects and advantages of the present teachings may be realized and attained by practice or use of the methodologies, instrumentalities and combinations particularly pointed out in the appended claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 4 is an example of the matchback code data contents.

FIG. 5 is an example of the data returned from the postal authority for Address Change Service.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

Figure 1:
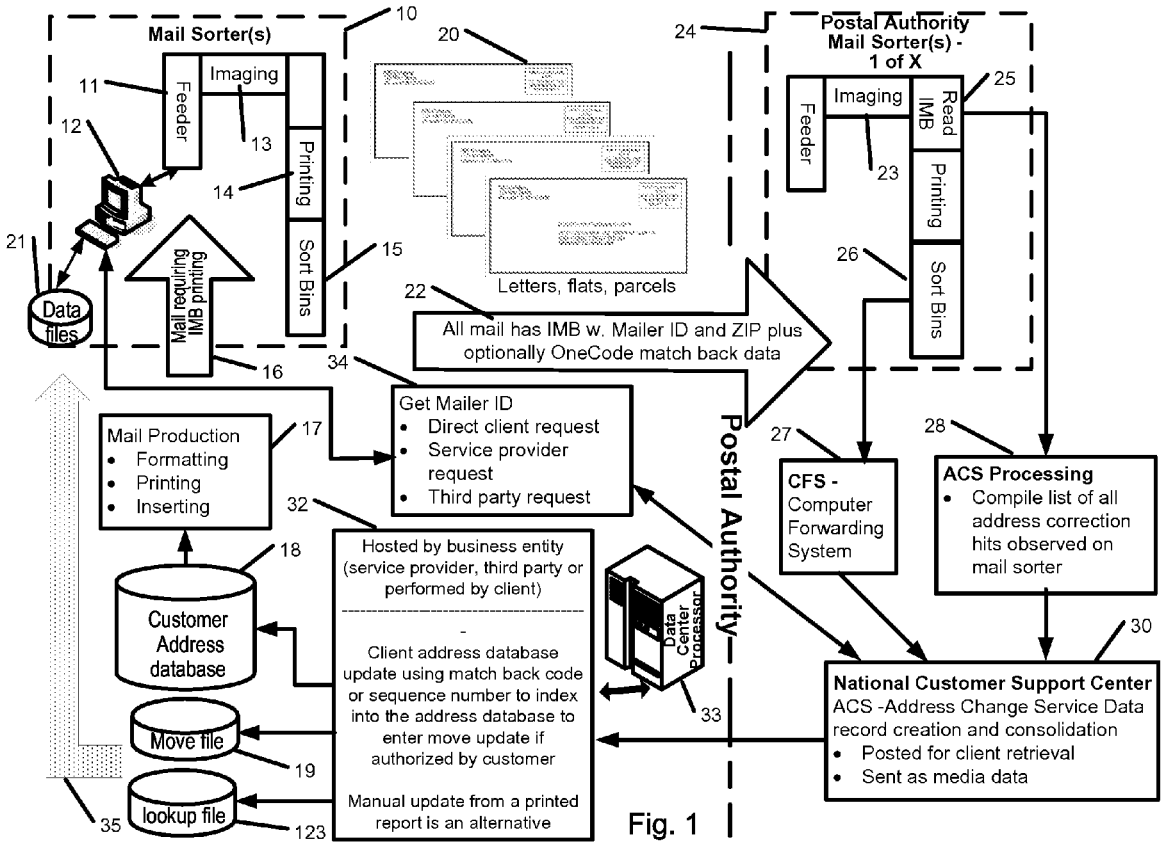
FIG. 1 is an exemplary system diagram of an address change service which prints tracking codes and receives address change service from the postal authority for client address list updates resulting from customer moves.

Reference now is made in detail to the examples illustrated in the accompanying drawings and discussed below. FIG. 1 illustrates exemplary system components and processes to enable a sorter or other suitable mail processing systems to print the IMB on one or more mail pieces of a mailing. The printed IMB may indicate the selection of the ACS service, and may also include other data related to the mail piece, such as the mailer, additional services selected, or the delivery point address, or any suitable combination thereof, or any other suitable information related to the delivery or processing of a mail piece.

As illustrated in FIG. 1, components may include, for example, mail to be processed 16 and one or more sorters 10. Sorters 10 may produce IMB coded mail 20 for delivery by the postal authority. IMB coded mail 20 may preferably have ACS service requested within the IMB code, and may also include, for example, a mailer identifier number, a delivery point address code (e.g., a ZIP® code or other suitable code, etc.), or a unique identifier (e.g., a match back code for accessing an address record in an address list, a unique number defining a uniqueness of a mail piece for a predetermined period of time, or any other suitable identifiers as discussed herein), or any combination thereof.

Systems and processes for address correction feedback are also illustrated in FIG. 1, and include postal sorters 24 or Computer Forwarding Systems (CFS) 27 to process the mail and return move update data (e.g., revised address data for an addressee from a previous address to a new address, and may include additional information related to the address or addressee) to a national customer support center (NCSC) 30. An address change service data record may be sent from the national customer support center 30 to a data center processor 33. Data center processor 33 may be communicatively coupled to the customer address database 18, and may accordingly update address data for one or more addressees using the address change service data record (e.g., address change service data record 64 shown in FIG. 5) received from the nation customer support center 30. Additionally, data center processor 33 may be configured to generate a move file 19 from the received address change service data record. The move file 19 may be, for example, collection of the corrected addresses received from NCSC 30 that were not updated in the customer address database 18 due to lack of permission from the customer to change the customer's permanent address record.

Business entities that use the ACS service are given numerous titles by those familiar with the postal service. For the purpose of this illustration, a client is the business entity that wishes to communicate with customers to achieve some business objective. The client usually maintains the integrity and accuracy of their customer address lists; although some clients may choose to contract for the address maintenance process. The service provider is the business entity, generally hired by the client to prepare the mail for delivery to the postal authority. The contracted services may include, but are not limited to, document preparation, printing, inserting, and sorting. The client may choose to keep one or more of these functions in-house based on their business model, for security reasons, or for any other suitable reason. In addition, the service provider may be contracted for address list maintenance, or a third party may be used which specializes in address processing.

Figures 2, 3:
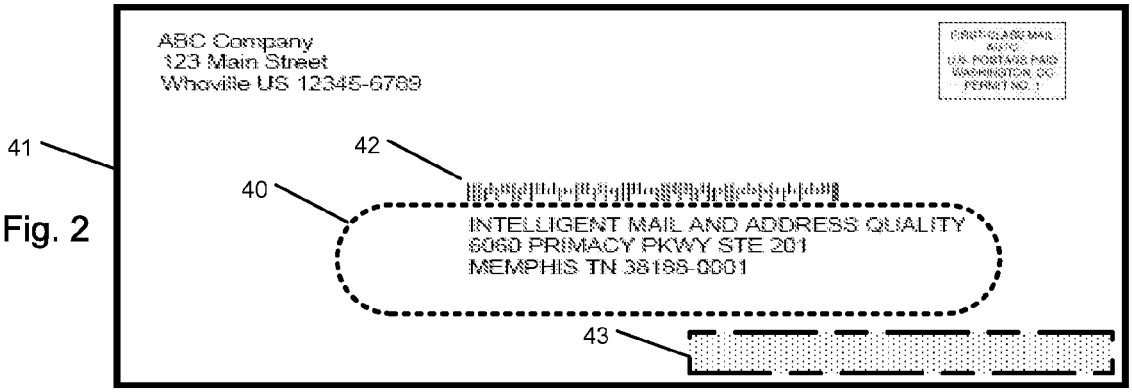
FIG. 2 is an example of an envelope containing an Intelligent Mail Barcode (IMB).
FIG. 3 defines the data fields within the IMB.

FIG. 1 also illustrates the process of printing an IMB on one or more mail pieces 16. The process may be for mail pieces 16 that do not have a printed IMB, or that have an address block IMB to be updated with additional parameters. The IMB may be printed, for example, in the clear zone 43 (as illustrated in FIG. 2) on the lower right corner of the mail piece 16. In the exemplary process, ACS has been selected by the mailer so as to be compliant with move update requirements for mail that is submitted for and is qualified to receive postage discounts, from, for example, the United States Postal Service (USPS) or any other suitable postal authority. The one or more mail pieces 16 that makeup the mailing may be created in a mail factory 17 by the client or service provider. Mail factory 17 may format, print and insert one or more documents into envelopes to form mail pieces 16. The mail factory 17 can be configured in numerous ways and may be one company or several companies. A distributed form of mail factory operations entails a client providing an address list and print file to a print shop that prints the documents, as well as inserts. The documents and inserts are then provided to a letter shop that inserts the documents and inserts into an envelope to create a mail piece. The letter shop then provides the finished mail pieces to a presort company to sort the mail in accordance with postal authority standards and print an IMB on the envelope. Any combination or grouping of these functions may occur in the mail production business.

The one or more mail pieces 16 of a mailing are processed by sorter(s) 10. Sorter(s) 10 may be any suitable mail piece sorter or other mail processing system. The sorter 10 may be comprised of a feeder 11, that singularizes a plurality of mail pieces (e.g., in a stack formation) into individual mail pieces in the transport of sorter 10. Sorter 10 may also include an imaging system 13 that may utilize optical character recognition (OCR) or other suitable techniques for capturing address information, addressee information, or other suitable information from the mail pieces. Sorter 10 may also include a printer 14 which may print machine-readable codes (e.g., barcodes, etc.) indicating, e.g., service type, mailer identifier, unique identifiers, or delivery point address codes, or any other suitable information onto the mail pieces. Sorter(s) 10 may also include sort bins 15 to collect mail pieces in accordance with postal authority presort rules for grouping mail pieces (e.g., by delivery point address code or by any other suitable grouping).

The sorter(s) 10 may further include one or more processors 12, which may be configured to control, e.g., control feeder 11, imaging system 13, barcode printer 14, etc. Processor(s) 12 may also provide an operator interface (e.g., to a display screen to an operator of sorter 10), processing of OCR data or other related data from imaging system 13, and perform address or addressee lookup from one or more address databases or data files. Processors 12 may also be configured to control printing (e.g., control printer 14 for printing IMB codes on one or more mail pieces) and operations of sort bin 15. Sorter 10 may optionally include a machine code verifier (e.g., barcode verifier, etc.) to verify the accuracy and quality of the printed output of the machine readable code on the one or more mail pieces. The sorter 10 can have one or more computing devices which make up the sorter processor 12 that are used for run time machine control, sort and printing control, barcode reading, multiple image processing, address processing, move update, cursive recognition and any other functions for sorter and peripheral equipment operation.

The output of the sorter 10 may be one or more mail pieces of a mailing that have a valid IMB (e.g., IMB 42, as illustrated in FIG. 2) printed on the front of the envelope 41. The valid IMB may be printed within an address block on an envelope. As shown in FIG. 2, the IMB 42 may be located, for example, adjacent to address block 40, or located in, for example, a clear zone 43 in the lower right section of the envelope 41.

The IMB may be generated by mail sorter 10 (e.g., by processor 12) from the address data 40 (shown in FIG. 2), by, at least in part, capturing addressee and address data 40 using imaging system 13. Additionally, the IMB (e.g., IMB 40 of FIG. 2) may be generated by utilizing data entered into the processor 12 by, for example, an operator of sorter 10, or retrieved from one or more data files stored on one or more digital storage devices 21 communicatively coupled to sorter processor 12.

In a multiple sorter environment, at least some of the data for generating the IMB may be transferred from one or more servers or digital storage devices communicatively coupled to a plurality of sorters for processing the mailing.

Turning to FIG. 3, an exemplary IMB data structure 54 is illustrated. The first data field 44 is a barcode identifier, which may be, for example, two digits or more in length. The field 44 is reserved for future use by the postal authority. The second data field 46 may be, for example, three or more digits in length or any other suitable length, and may be used to identify whether ACS address service is requested, or whether ACS address service and Confirm is requested. For example, the digits 080 may be used to identify a request for ACS and the digits 140 may be used to identify the request for combined service of ACS and Confirm. Confirm is the USPS service that is used to track a mail piece through the postal network and confirm its delivery. The third exemplary data field 48 may indicate a mailer identifier number ("Mailer ID"). The third data field 48 may be, for example, six digits in length or any other suitable length. The Mailer ID may be assigned to the participant which is usually the client or service provider, although a third party address service provider could be designated. The participant may request multiple Mailer IDs to correlate with different customer address lists. The Mailer ID relates to the business entity that will receive the address correction data from USPS and any fees associated with the service.

The fourth data field 50 of exemplary IMB data structure 54, may be, for example, nine digits in length or any other suitable length, and is reserved for the participant to specify. For example, if the confirm service and ACS are selected, this field may contain a unique number which remains unique for a specified period of time which is substantially long enough to ensure no ambiguous tracking results can occur because two mail pieces with the same Mailer ID and identification number are in the postal network at the same time. The unique number may contain match back data or reference match back data provided the uniqueness requirement is met. If ACS is selected, the fourth data field 50 can be allocated for a match back code that is used to efficiently access the correct address data record in the client's address list. Use of a match back code may enable cost effective address and addressee record updating. The match back code may also serve as a unique identification number, thus allowing for both Confirm and ACS with match back. The fifth data field 52 may be, for example, reserved for the delivery point address code 52 (e.g., ZIP code) which can be 0, 5, 9 or 11 digits in length, or any other suitable number of digits to identify a delivery point address code.

Additional detail regarding generating the IMB is discussed in further detail below in connection with FIGS. 6-8. Alternative versions of the data assignments for the IMB data fields will evolve as postal authority requirements change. For example, the digit allocations maybe adjusted between Mailer ID (e.g., third data field 48) and unique identifier (e.g., match back code, unique number, or other participant-reserved code for fourth data field 50). Also, for example a sorter identification code (i.e., sorter ID) field maybe added to identify an entity performing the printing and/or sorting of mail pieces. Additionally, the length of one or more fields (e.g., fields 44, 46, 48, 50 52) may be increased or decreased as needed, and the number of fields in the IMB may also be increased or decreased. For example, to accommodate an increase in the number of fields or in the length of one or more fields, the length of the IMB machine readable code (i.e., barcode) may be extended, or a higher density barcode may also be used. The match back process is enabled by using one or more of the fields within the IMB as appropriate.

The Mailer ID (e.g., which may be indicated in third data field 48 of the IMB) is a component of the ACS process. The Mailer ID is obtained before the one or more mail pieces associated with a mailing are processed on a sorter (e.g., sorter 10 of FIG. 1). The Mailer ID may be obtained by a business entity 34 (e.g., client, service provider, or a third party address maintenance provider or any other suitable entity). The business entity 34 registers and obtains a Mailer ID from the National Customer Support Center (NCSC) (e.g., National Customer Support Center 30, illustrated in FIG. 1) prior to processing an ACS mailing. The Mailer ID may be made available to the sorter processor 12 either through operator entry, transfer of data from one or more servers or digital storage devices, or through the selection of a predefined mailing job description that contains data related to process a mailing.

The match back code or unique identifier are components of the ACS since the service is only effective if the participant updates their address lists when move data is returned from the NCSC 30. The address update process 32 utilizes the Address Change Service data record 64 (as shown in FIG. 5) returned from the NCSC 30 to perform the address update in the customer address database 18 and optionally create a move file 19 for any addresses that are not updated in the customer address database 18. The move file creation and customer address database updates as performed in block 32 are performed in the data center processor 33 which may be a server, a PC or other computer data processing configuration.

One option for the customer address database 18 update is to use the fourth data field 50 (as shown in FIG. 3) of the IMB 54 for a match back code. This code may be, for example, designed by the address list data administrator to facilitate the automated update or computer assisted update of the customer address file, which is one entry in the customer address database 18, associated with the move. The match back code may enable increased accuracy and increased speed in accessing the correct customer address file within the address list. The client, service provider, or third party address maintenance service may determine how the match back code is generated depending on the data structure of the customer address database 18 and the structure of the customer address file and the database software.

One exemplary match back code construction is shown in FIG. 4. The exemplary 9-digits allocated in fourth data field 50 (illustrated in FIG. 3) may be used for the match back code, which, as shown in FIG. 4, is divided into three groups. Group one is the first two letters of the first name 61, the second group is the first two letters in the last name 62 and the final group is the last or low order three numbers of the street number 63. This match back code may be combined with the Mailer ID 48 and old address delivery point code 52 to provide increased accuracy of retrieving the correct address data record for a customer address file to enable efficient updating of address records associated with the ACS data record 64 returned from the NCSC 30. During operation of the sorter (e.g., sorter 10 shown in FIG. 1), a match back code may be generated as at least a part of the OCR process where, for example, the three groups of data (e.g., groups 61, 62, and 63 of match back code 50 shown in FIG. 4) are recognized. The resulting code may be used to generate the IMB (e.g., in fourth data field 50 of IMB illustrated in FIG. 3) before it is printed on the envelope.

An alternative approach, when Confirm and ACS services are both selected, is to generate a unique identifier which is stored in the lookup files 123 on at least one digital storage device 21 communicatively coupled to processor 12 that contains a unique identifier for each customer address file, which meets USPS standards for the uniqueness period (e.g., 45 days or any other suitable period of time) and contains match back data. The unique identifier which is stored in the lookup file 123 is created in the data center processor 33 from a combination of customer address database 18 features such as data record pointers, address contents, account information, random number and other parameters that can be combined with an algorithm such as a hash code algorithm to produce a unique identifier number 50 (as shown in FIG. 3). This unique identifier number 50 may be decoded during the address update process at block 32 to locate the same address record in the customer address database 18 that was used to create the unique identifier. An alternative to using a hash algorithm to combine data, as explained above, into a unique match back code is to create a unique number that will not be repeated for a predefined period of time determined by the postal authority. The unique number may be a sequence number provided the sequence number can have a sufficient range to be unique for the period required by the postal authority. The unique number is cross-referenced to a match back code for the specific customer address file being processed on the sorter 10 so that the match back code can be obtained when the unique number 65 (as shown in FIG. 5) is returned from NCSC 30 by using the cross reference. The unique number and associated cross reference may be included in the lookup file 123. The processor 12 of sorter 10 may access the data files 21 to obtain the correct unique identifier based on the address block data 40 returned from the imaging system 13 that may utilize optical character recognition (OCR) or other suitable techniques for obtaining address information from scanned address data on a mail piece. The unique identifier may then be encoded into the IMB (e.g., in fourth data field 50 of IMB 54 shown in FIG. 3). This unique identifier may be used to access the address data file that requires a move update when the ACS data record 64 (as shown in FIG. 5) is received from NCSC 30 shown in FIG. 1. In the case where either the match back code or unique identifier cannot be determined and added to the IMB, the Confirm and ACS services as described herein may not be available because of the lack of a unique identifier or match back code.

Referring again to FIG. 1, the output of sorter 10 is one or more mail pieces 20 that have a valid IMB printed on them with the ACS or ACS+ confirm selected, a Mailer ID, a delivery point address code, and a unique identifier or match back code 22. The one or more mail pieces 20 are then delivered to the postal authority for processing, such as on mail piece sorter 24. The postal authority may use other mail processing equipment for the ACS operation such as an Advance Facer Canceller System (AFCS), or any other suitable mail processing systems. On the first observation of the mail piece, the IMB may be read by a barcode reader 25, or, alternately, may have been read by a barcode read module or other machine readable code reader which is incorporated into the imaging system 23. The delivery point address code may be decoded and evaluated along with the addressee name which is read by imaging system 23 to determine if that individual or firm has moved. The sorter system 24 updates the address delivery point address code using the postal authority move update system and updates the IMB on the mail piece. The ACS processing system 28, which is communicatively coupled to mail sorter 24, may compile a list of move updates for each move returned by postal authority move update system and forward this data along with the IMB data to the National Customer Support Center (NCSC) 30 for creation of the data to be returned to the participant. Some of the mail pieces may encounter a processing error in postal authority move update system and be diverted to a reject bin allocated from the sort bins 26 on the postal authority sorter 24 for additional processing on the Computer Forwarding System (CFS) 27. A typical processing error may be the recognition that a move has occurred at the delivery point address code but the OCR by imaging system 23 could not correctly read the addressee from the mail piece. The CFS 27 allows an operator to view the address data and to retrieve a correct move update from the postal authority national change of address file. The CFS 27 may also generate a list of move updates and forward the data to the NCSC 30.

The NCSC 30 is communicatively coupled to the move update processing systems, such as sorters 24, CFS 27, or other systems. The data associated with a move (as sent to the NCSC 30 via the CFS 27 and the postal authority sorters 24) is transferred on a periodic basis. FIG. 5 illustrates Address Change Service Data Records 64, which may include exemplary data that may be transferred and compiled. For example, Address Change Service Data Records 64 may include, but is not limited to, the following data: Mailer ID, matchback code data, addressee name, old (i.e., previous) address data, new (i.e., present) address data, move type data (family move, individual move, etc.), or effective move date, or any combination thereof, or any other suitable data. The NCSC (e.g., NCSC 30 shown in FIG. 1) will compile the move update data for each Mailer ID over a predetermined period of time and make this data available to the participant (e.g., as an electronic file, via a web interface, or as a printout, or by having the data available by any other suitable means). The data returned to the participant may include the Mailer ID, unique identifier (e.g., generated match back code, unique number or match back code obtained from the lookup file 123), name for addressee, old address, new address, move type—family/individual, or move effective date—month and year, or any combination thereof.

The ASC data record 64 (as shown in FIG. 5) from NCSC 30 is processed by the business entity 32 (e.g. client, service provider, or a third party address maintenance provider). The ACS data record 64 is sent to the registered participant (the business entity that requested the mailer ID at block 34) who may forward the ACS data record 64 to the organization responsible to update the customer address files in the customer address database 18. These updates, as described above, may be automatic (e.g., using various database update techniques) or may be semi-automatic such as with computer assisted manual updates. The net result is an updated address list that will be used next time mail is produced to minimize or avoid the need for ACS and facilitate the efficient delivery of mail by USPS. An option is for the data center processor 33 to generate a move file 19 that contains addresses that have a recent move update that may not yet be incorporated into the customer address database 18 used to create the mailing. Typically the move file 19 is the move update addresses for customers that have not yet given approval to the business entity 32 to update their address with the ACS data record 64 (as shown in FIG. 5). The move file 19 is transferred via communication link 35 to the data files 21 before the sorter (e.g., sorter 10 shown in FIG. 1) processes this mailing. The move file 19, which contains move data not incorporated into the customer address database 18, may be used by the imaging system 13 to replace the old address from the customer address database 18 with the new address 66 obtained from the ACS data record 64 (as shown in FIG. 5). The new address will be used for encoding in the IMB before it is printed on the mail piece (e.g., by printer 14 in FIG. 1). This may improve the mail delivery and reduce the likelihood that the participant will exceed the limit for free ACS for that addressee, as determined by a postal authority.

Figure 6:
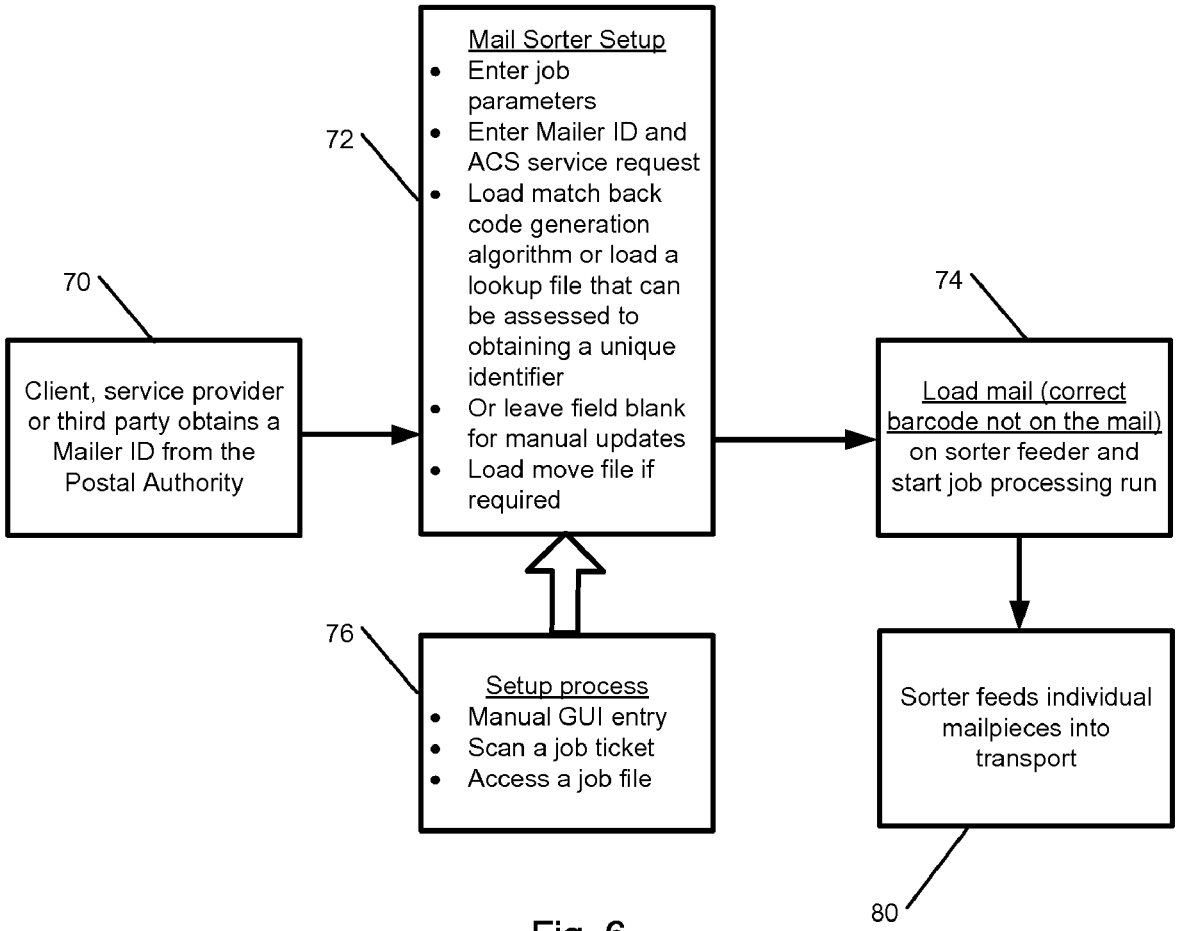
FIG. 6 is a process flow of the setup before a sorter is operated to apply the IMB code for address change service.

FIG. 6 illustrates an exemplary process for job setup before processing one or more mail pieces for a mailing. An ACS job may not be run without the client, service provider, or third party address maintenance service obtaining a registered Mailer ID from the postal authority (i.e., USPS) at block 70. With the Mailer ID available (from block 34), the mail sorter setup may begin at block 72. The job parameters for running the mail process are entered, for example, into mail sorter processor 12 illustrated in FIG. 1. These parameters may define the mail type (Standard or First Class, etc.), client data, sort scheme, any combination thereof, or any other parameters to prepare and sort the mail in accordance with predefined USPS requirements. The Mailer ID and service request, ACS, or ACS plus Confirm are entered in block 72. The match back code generation algorithm or file access algorithm used to find a unique identifier in the lookup file 123 may be selected, and corresponding data files 21 may be setup and enabled. The move file 19 must be selected if address updating is to be performed as explained above. Setup is performed by the sorter operator through a GUI attached to the sorter processor 12. The job to be run is identified from a job ticket paper work and the associated data files 21 are referenced. If the algorithms are not already loaded into the sorter processor 12, this step must be performed. The setup process 76 can be accomplished using manual entry through a GUI interface in the sorter processor 12 or sorter server (not shown). Operators may use a higher level of automation for setup to avoid possible error in manual entry. These techniques include, but are not limited to: scanning a job ticket to identify the job, accessing the data contained in a job file that was prepared in advance, or any other steps that may automate the setup process. Once setup is complete, the mail to be sorted and have a IMB printed is loaded onto the feeder magazine (e.g., of sorter 10 shown in FIG. 1) and the mail processing job is started 74. The move file 19 and the lookup file 123 must both be transferred via communication link 35 from the data center processor 33 to the data files 21 before the mail job is run if these files are required to execute the mailing job (as shown in FIG. 1).

Figure 7:
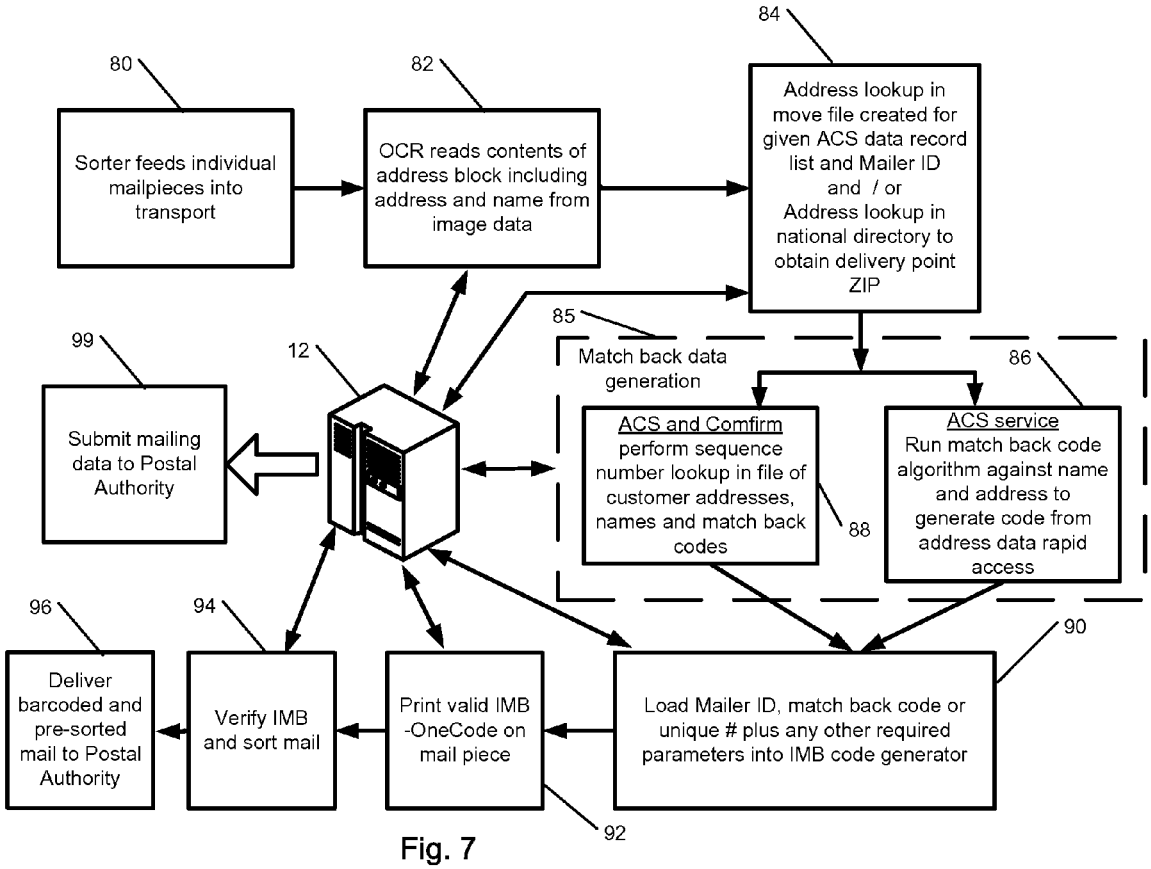
FIG. 7 is a process flow for sorter operations.

During sorter processing of the one or more mail pieces of a mailing, as illustrated in FIG. 7, the sorter (e.g., sorter 10 shown in FIG. 1) singularizes the mailing comprising a plurality of mail pieces from a stack of mail into individual pieces and feeds them into the transport at block 80. The feeder 11 is coupled to the imaging system 13 that reads the address and addressee from the address block on each respective mail piece of the mailing at block 82. Next, the delivery point address code (i.e., ZIP code) at block 84 is determined. A move file 19 may be selected from a group of move files for various jobs that are included in the data files 21 which are accessible by the processor 12 to be used during mail sorter setup (e.g., block 72 of FIG. 6). The imaging system 13 and processor 12 will lookup the addressee or address and addressee in the move file 19 to determine whether a move data record exists for the addressee, or address and addressee currently being processed on the sorter 10. If a match is found, the destination delivery point address code in the move data record in the move file 19 is used to generate the IMB (e.g., at block 90). The postal authority may require that a human readable version of the delivery point ZIP be printed in addition to the IMB. This may be desirable, as the delivery point address code may be different from the address visible in the address block on the mail piece, thus creating confusion for the postal carrier. The move file 19 is associated with the mailing job being processed and generally is maintained by the business entity 32 (e.g., client, service provider, or third party) responsible for address maintenance. The move file 19 is not a global move update record maintained by the USPS. Rather, move file may include one or more address records received from NCSC (e.g., NCSC 30 shown in FIG. 1) that were not updated in the customer address database 18. If the move file 19 is not being used or no match is found between the address and addressee and the move data record in the move file 19, the address data, addressee data, or address and addressee data may be retrieved from the national address directory to obtain the delivery point address code (e.g., ZIP code, etc.). The imaging system 13 does not actually use the national address directory maintained by the postal authority, since this directory in not in a suitable searchable structure. Custom directory files are used instead which match the requirements of the imaging system 13 matching algorithms for search speed and effective lexicon utilization.

Two alternative exemplary methods are discussed below for generating match back data at block 85 for encoding in the IMB and for later use when the ACS data record 64 (as shown in FIG. 5) is returned from NCSC 30 (as shown in FIG. 1). If ACS service is selected (e.g., during mail sorter setup block 72 of FIG. 6), the selected match back code algorithm utilizes address block data 40 (as shown in FIG. 2) from an imaged mail piece at block 86 to generate a match back code. If both ACS and Confirm are selected (e.g., during mail sorter setup block 72 of FIG. 6), the lookup file 123 for the selected job is accessed in the data files 21 is queried to obtain a unique identifier number based on the address contents (as obtained by the imaging system 13 in FIG. 1) at block 88.

Alternately for block 86, a lookup file 123 (as shown in FIG. 1) may be used for ACS if improved accuracy in the match back code is desired beyond that which can be created from an algorithm that utilizes addressee data, or address and addressee data obtained from the address block 40 (as shown in FIG. 2) on a mail piece that has been imaged (e.g., by imaging system 13 shown in FIG. 1).

A broad variety of match back code algorithms may be used for methods of creating a unique identifier that both meets the USPS uniqueness requirements and assists in the address record match back process. One exemplary match-back code generation algorithm is described above in connection with FIG. 4. The lookup file 123, match back code generation algorithm, customer address database 18 (as shown in FIG. 1) and customer data and address records database 124 (as shown in FIG. 8), may vary depending on the design preferences of the business entity 32 and implementers of mail processing systems.

The data to generate the IMB 54 (as shown in FIG. 3) is collected and used to generate the IMB at block 90 of FIG. 7. Next, at block 92, the generated IMB is printed on the appropriate mail piece, and is verified for accuracy and the quality of the printed output at block 94 with a barcode verifier (not shown). The processed mailing is then delivered to the USPS at block 96. At block 99, additional data (e.g., mail qualification report, Postage summary report, etc.) or documentation as requested by the postal authority may be provided.

The sorting and ACS functions illustrated in FIG. 7 are controlled by the sorter processor 12 system which may include numerous computers to accomplish the user interface, control, OCR, IMB printing and data reporting required for operation of the sorter functions. Numerous other sorter and ACS functions may be executed by the sorter computers.

Figure 8:
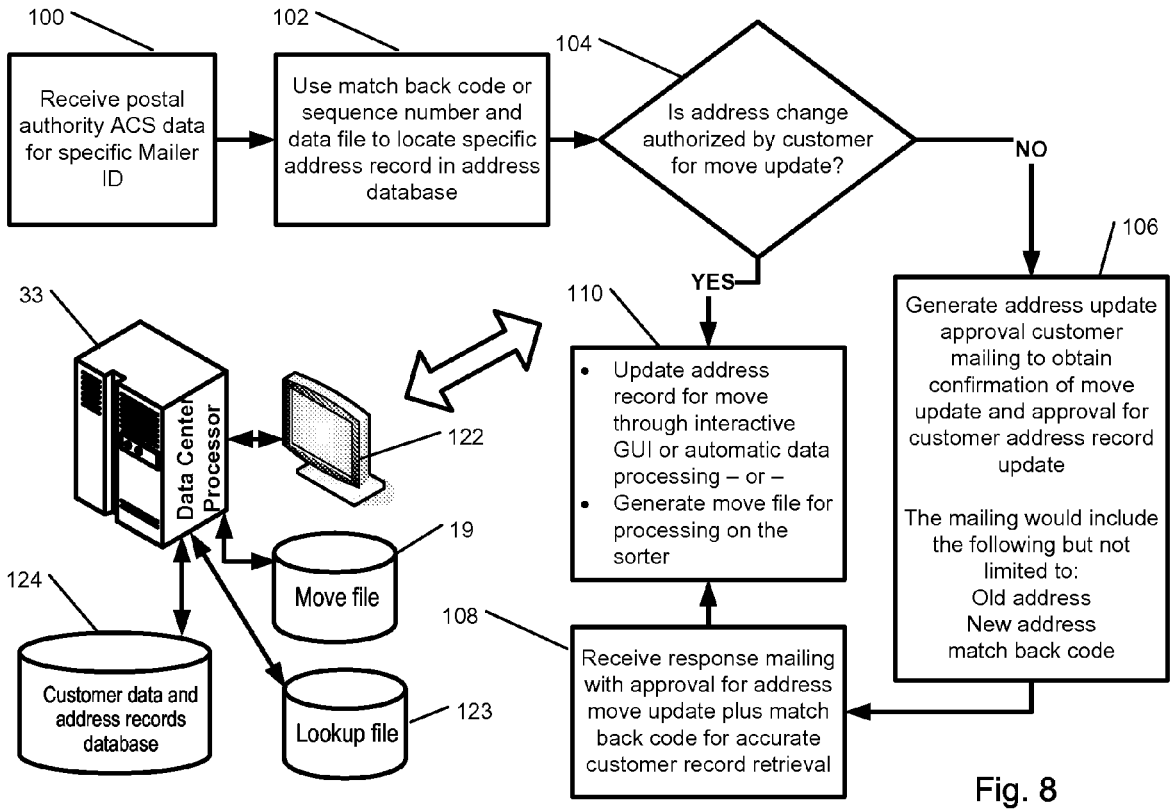
FIG. 8 is an exemplary process flow diagram for the ACS customer address move update.

FIG. 8 illustrates an exemplary method for updating the customer address database 18 which may be a part of the customer data and address records database 124. The USPS returns the address change service data record 64 (illustrated in FIG. 5) for a specific Mailer ID participant at block 100. The customer address record is located in the customer address database 18 (shown in FIG. 1) using, for example, the match back code or unique identifier, the delivery point address code (i.e., ZIP), or the Mailer ID, or any suitable combination there of at block 102. Many businesses are not allowed to update the master address list due to legal constraints without specific customer approval. For example, this is a common practice for insurance companies, since changing the address could result in a mis-delivery which may result in the customer failing to pay a premium needed to keep the policy in force. Therefore, a decision whether to update the master list is determined at block 104. If there is approval to update the customer address database 18, the customer address record is updated at block 110 using, for example, an interactive graphical user interface (GUI) 122 communicatively coupled to data center processor 33. Alternatively, the address list update may be automatically performed, as described above. Also, at block 110, a move file 19 may optionally be generated to enable move updates on the sorter prior to the update of the customer address database 18 (as shown in FIG. 1). If customer approval does not exist for updating the master address list at block 104, a mailing may be generated of either postcards or letters addressed to the customer using the original address at block 106. The mailing may contain, but is not limited to: the old address, the new address, a match back code, a mail back approval, denial postcard, or letter insert, or any suitable combination thereof. The return mail would normally be postage paid and business reply mail. Those skilled in the art may use other alternatives to obtain customer approval such as e-mail notification. Once the reply mail is received at block 108 from the customer with approval granted the address file is updated, the move file is generated at block 110. Or, if address update approval is denied and move file 19 not in use, no action is taken at block 110. If the move file already contained an address which is updated in the customer address database after the approval is received, that address will be purged from the move file. The address maintenance process is executed on a data center processor 33. The data center processor 33 is hosted by the client, service provider or third party address maintenance service. The individual address record is maintained as part of a customer address list which may be contained in a database 124. The customer data and address records database 124 contains both the customer address database 18 and specific customer data about the account such as account numbers and financial data. The customer data and address records database 124 may contain numerous customer address databases as well as customer data for the various accounts associated with the client's business. The data center processor 33 also generates the move file 19 that will be transferred to the sorter processor (e.g., processor 12 illustrated in FIG. 1) for use when mail for the associated customer address database 18 is processed.

While the foregoing has described what are considered to be the best mode and/or other example, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A method for processing a mailing including one or more mail pieces on mail processing equipment, the method comprising steps of:

(a) image capturing address data, addressee data, or address and addressee data associated with each respective mail piece of the mailing;

(b) determining a unique identifier for the respective mail piece and determining a delivery point address code for the respective mail piece based at least in part on the captured address data, addressee data, or address and addressee data;

(c) generating a machine readable code comprising at least a mailer identifier for the mailing, address change service request and the unique identifier;

(d) printing the machine readable code on the respective mail piece; and (e) sorting each respective mail piece.

2. The method of claim 1, further comprising initializing the mail processing by receiving a selection of one or more predetermined processing parameters for the mailing, receiving a selection at least one address change service request, determining the mailer identification code, or receiving a selection of a process for determining the unique identifier, or any combination thereof.

3. The method of claim 1, wherein the determining the unique identifier comprises generating a match back code for accessing an address record in an address list, wherein the matchback code is based at least in part on the captured address data, addressee data, or address and addressee data.

4. The method of claim 1, wherein the determining the unique identifier comprises determining a unique number defining the uniqueness of a respective mail piece for a predetermined period of time.

5. The method of claim 1, wherein the determining of the delivery point address code comprises retrieving address data, or address and addressee data from at least one data record in a move data file based on the captured address data, addressee data, or address and addressee data.

6. The method of claim 1, wherein the determining of the delivery point address code comprises retrieving the delivery point address code from a national data directory based on the captured address data, addressee data, or address and addressee data.

7. The method of claim 1, wherein the generated machine readable code further comprises the delivery point address code.

8. The method of claim 1, further comprising:

verifying the machine readable code on each respective mail piece to determine the accuracy, quality, or accuracy and quality of the printed machine readable code; and sorting each respective mail piece with a verified machine readable code from each mail piece with an unverified machine readable code.

9. The method of claim 8, further comprising delivering the verified and sorted one or more mail pieces having printed machine readable code to a postal authority.

10. A method for processing a mailing including one or more mail pieces on mail processing equipment, the method comprising steps of:

(a) capturing address data, addressee data, or address and addressee data associated with each respective mail piece of the mailing;

(b) determining a unique identifier for the respective mail piece and determining a delivery point address code for the respective mail piece based at least in part on the captured address data, addressee data, or address and addressee data;

(c) generating a machine readable code comprising at least a mailer identifier for the mailing, address change service request and the unique identifier; and (d) printing the machine readable code on the respective mail piece, wherein the determining the unique identifier comprises retrieving a predetermined match back code from a lookup file, the predetermined match back code associated with the address data, addressee data, or address and addressee data.

11. A mail processing system for processing a mailing including one or more mail pieces, the system comprising:

(a) an image capture device configured to capture address data, addressee data, or address and addressee data associated with each respective mail piece of the mailing;

(b) a processor configured to:

determine a unique identifier for the respective mail piece and determine a delivery point address code for the respective mail piece based at least in part on the captured address data, addressee data, or address and addressee data;

generate a machine readable code comprising at least a mailer identifier for the mailing, address change service request and the unique identifier;

(c) a printer communicatively coupled to the processor, wherein the printer is configured to print the machine readable code on the respective mail piece; and (d) a sorter for sorting each respective mail piece.

12. The system of claim 11, wherein the mail processing system is configured to receive a selection of one or more predetermined processing parameters for the mailing, receive a selection of at least one address change service request, determine the mailer identification code, or receive a selection of a process for determining the unique identifier, or any combination thereof.

13. The system of claim 11, wherein the processor is further configured to generate a match back code for accessing an address record in an address list, wherein the matchback code is based at least in part on the captured address data, addressee data, of address and addressee data.

14. The system of claim 11, wherein the processor is further configured to determine a unique number defining the uniqueness of a respective mail piece for a predetermined period of time.

15. The system of claim 11, wherein the processor is further configured to determine the delivery point address code by retrieving address data, or address and addressee data from at least one data record in a move data file based on the captured address data, addressee data, or address and addressee data.

16. The system of claim 11, wherein the processor is further configured to determine the delivery point address code by retrieving the delivery point address code from a national data directory based on the captured address data, addressee data, or address and addressee data.

17. The system of claim 11, wherein the processor is further configured to generate machine readable code using the delivery point address code.

18. The system of claim 11, wherein the mail processing system is further configured to:

verify the machine readable code on each respective mail piece to determine the accuracy, quality, or accuracy and quality of the printed machine readable code; and sort each respective mail piece with a verified machine readable code from each mail piece with an unverified machine readable code.

19. The system of claim 18, wherein the mail processing system is further configured to deliver the verified and sorted one or more mail pieces having printed machine readable code to a postal authority.

20. A mail processing system for processing a mailing including one or more mail pieces, the system comprising:

(a) an image capture device configured to capture address data, addressee data, or address and addressee data associated with each respective mail piece of the mailing;

(b) a processor configured to:

determine a unique identifier for the respective mail piece and determine a delivery point address code for the respective mail piece based at least in part on the captured address data, addressee data, or address and addressee data:

generate a machine readable code comprising at least a mailer identifier for the mailing, address change service request and the unique identifier;

retrieve a predetermined match back code from a lookup file, the predetermined match back code associated with the address data, addressee data, or address and addressee data; and (c) a printer communicatively coupled to the processor, wherein the printer is configured to print the machine readable code on the respective mail piece.

21. A method for processing a mailing including one or more mail pieces on mail processing equipment, the method comprising:

(a) image capturing address data, addressee data, or address and addressee data associated with each respective mail piece of the mailing;

(b) accessing a move data file associated with the mailing, the move data file having at least address data, addressee data, or address data and addressee data for move updates, using the captured address data from the mailing;

(c) retrieving a delivery point address code from the move data file;

(d) generating a machine readable code using the delivery point address code, address change service request and a unique identifier; and (e) printing the machine readable code on the respective mail piece.

22. A system for processing a mailing including one or more mail, the system comprising:

(a) an image capture device configured to capture address data, addressee data, or address and addressee data associated with each respective mail piece of the mailing;

(b) a processor configured to:

access a move data file associated with the mailing, the move data file accessed from at least one digital storage device using the captured address data from the mailing, the move data file having at least address data, addressee data, or address data and addressee data for move updates;

retrieve a delivery point address code from the move data file; and generate a machine readable code using the delivery point address code, address change service request and a unique identifier; and (c) a printer configured to print the machine readable code on the respective mail piece.

* * * * *